US005619966A

United States Patent [19]

Aubourg et al.

[11] Patent Number: 5,619,966

[45] Date of Patent: Apr. 15, 1997

[54] METHOD FOR CONTROLLING AN INTERNAL COMBUSTION ENGINE AS IT ENTERS LOW-IDLE SPEED

[75] Inventors: Alain Aubourg, Saint-Jean; Jean Cosault, Muret, both of France

[73] Assignee: Siemens Automotive, S.A., Toulouse Cedex, France

[21] Appl. No.: 535,222

[22] PCT Filed: Apr. 5, 1994

[86] PCT No.: PCT/EP94/01053

§ 371 Date: Oct. 16, 1995

§ 102(e) Date: Oct. 16, 1995

[87] PCT Pub. No.: WO94/24429

PCT Pub. Date: Oct. 27, 1994

[30] Foreign Application Priority Data

Apr. 14, 1993 [FR] France ..... 93 04372

[51] Int. Cl.[6] ..... F02D 41/16

[52] U.S. Cl. ..... 123/339.22; 123/339.23

[58] Field of Search ..... 123/339.19, 339.2, 123/339.21, 339.22, 339.23

[56] References Cited

U.S. PATENT DOCUMENTS

| | | | |
|---|---|---|---|
| 4,506,641 | 3/1985 | Hasegawa | 123/339.23 |

FOREIGN PATENT DOCUMENTS

| | | | |
|---|---|---|---|
| 0296323 | 12/1988 | European Pat. Off. . | |
| 0467353 | 1/1992 | European Pat. Off. . | |
| 2684933 | 6/1993 | France . | |
| 3-199647 | 8/1991 | Japan | 123/339.22 |
| 2162973 | 2/1986 | United Kingdom . | |
| 2168830 | 6/1986 | United Kingdom . | |

*Primary Examiner*—Andrew M. Dolinar

*Attorney, Agent, or Firm*—Herbert L. Lerner; Laurence A. Greenberg

[57] ABSTRACT

The speed of an internal combustion engine is monitored during the entry thereof into low-idle speed operation. The engine speed can thereby be slaved to a predetermined reference point value. When a predetermined engine condition occurs which is considered to require the engine to switch to idling speed, the set speed of the engine is forced downwardly according to a predetermined time law. The set speed thereby shifts towards the predetermine idling speed.

7 Claims, 2 Drawing Sheets

| $\|\Delta t\|$ | $\Delta N$ |
|---|---|
| 0 | 0 |
| 0.5 | 0 |
| 1 | 30 |
| 1.5 | 70 |
| 2 | 130 |
| 2.5 | 250 |
| 3 | 450 |
| 3.5 | 700 |
| 4 | 1300 |
| 4.5 | 2500 |

METHOD FOR CONTROLLING AN INTERNAL COMBUSTION ENGINE AS IT ENTERS LOW-IDLE SPEED

BACKGROUND OF THE INVENTION

Field of the Invention

The present invention relates to a method for controlling an internal combustion engine as it enters low-idle speed and, more particularly, to such a method designed for an engine associated with means for slaving its speed to a predetermined reference point value.

FIG. 1 of the appended drawing represents an internal combustion engine associated with such means. The engine 1 comprises an air inlet manifold 2 connected to a filter 3 and to an exhaust pipe 4, in which there is conventionally placed a muffler 5, possibly a catalytic converter. In a motor vehicle propelled by such an engine, there is also commonly found nowadays an electronic computer 6 fed by lines 7 for transmitting signals emitted by sensors (not represented) for sensing the speed of the engine, the air inlet pressure, the cooling water temperature, etc. . . . In return, the computer formulates, as a function of various strategies, orders for controlling actuators such as a spark plug 8 for igniting an air/fuel mixture, a fuel injector 9, a butterfly valve 10 for regulating the amount of air let in and a valve 11 controlling an additional air flow, mounted in parallel with the butterfly valve 10. At low-idle speed, with the air butterfly valve 10 closed, the computer regulates the "filling" of the cylinders of the engine with air, with the aid of the additional valve 11, so that the engine therefore turns over at a speed typically of the order of approximately 700 rpm.

As low-idle speed is entered, problems in matching the output torque of the engine to the resistive torques opposing it may be encountered. A "free" drop in the speed of the engine toward a fixed final reference point, as represented in FIG. 2 of the appended drawing, may cause this speed N to drop below the reference low-idle speed N (after the moment t) if friction internal to the engine and due, for example, to cold-starting or auxiliary equipment (alternator, compressor for climate control, power-assisted steering, etc.) increases the load on the engine. The engine may then sputter or even stall.

In order to overcome this drawback, European Patent No. 0 170 574 discloses a method, illustrated in FIG. 3, according to which, as low-idle speed is entered, the final fixed reference point N is replaced by a variable reference point N making it possible to cause the speed of the engine to change smoothly toward this final reference point. Solid line and broken line have been used respectively to represent the change in the actual speed N and in the reference speed N. The latter is fixed, at each moment t, to the value of the low-idle speed N increased by a fraction (100–x) % of the difference between the actual speed N and the low-idle speed N and thus progressively comes to meet this final low-idle speed. Regulators or "controllers" of the PI or PID type act, for example, on the degree of opening of the additional air control valve 11 in order to ensure that the reference point thus fixed is followed.

The use of such controllers is not without drawbacks. In point of fact, while the actual speed is dropping toward the final low-idle speed value, the intermediate reference point N is always below the actual speed N and there is therefore constant incrementation of the integral term in the regulation, which may give rise to a compensating underspeed after the actual speed has reached the final low-idle speed. Moreover, as the reference speed is a function of the actual speed, disturbances (surging) which may affect the latter have a knock-on effect on the reference point, with the introduction of phase shifts by the differential term of the regulation.

Furthermore, Patent Application GB 2 162 973 discloses a method for entering low-idle regulation which is characterized by the following of a reference point of exponential overall form, but the parameters of which depend in particular on the derivative of the speed as a speed threshold is crossed. Such a method exhibits drawbacks connected with the dependence of the reference point curve with respect to the initial conditions. Mention may be made, for example, of the case where the threshold for entering into low-idle regulation is crossed during abrupt braking of the vehicle, with the motor engaged. In this case, the derivative of the speed is high, leading to a very flat reference point curve. As soon as the engine is disengaged, the speed tends to catch up to the reference point curve, then situated very much above it, and this results in abrupt reacceleration of the engine. In the opposite case, very slow deceleration, the reference point curve is very steep, and in this case the risk is that engaging a load such as climate control, etc., may lead to the engine stalling.

SUMMARY OF THE INVENTION

The object of the present invention is therefore to provide a method for controlling an internal combustion engine as it enters low-idle speed, making it possible then to gain control over the change in speed of the engine and to avoid the aforementioned drawbacks of the methods of the prior art.

This object of the present invention, together with others which will become clear from reading the description which will follow, is achieved with a method for controlling an internal combustion engine as it enters low-idle speed, the engine being associated with means for slaving its speed to a predetermined reference point value, according to which method the engine is monitored for the possible appearance of a predetermined running state considered as calling for an entry into low-idle speed and, when such a state is detected, a decrease in the reference speed of the engine according to a predetermined time law independent of the rate of decrease in the speed when the predetermined state occurred is demanded, and this makes the reference speed tend toward a predetermined low-idle speed.

By virtue of this time-based control of the reference point speed, the drop in engine speed is perfectly controlled each time it returns toward a low-idle speed, and the underspeeds or stalling mentioned earlier are therefore avoided.

According to another characteristic of the method according to the invention, the actual speed is measured at the moment when the predetermined state occurs, and the decrease in reference point speed is initialized to this speed value according to the predetermined time law.

According to a preferred embodiment of the method according to the invention, the predetermined time law is stored in memory in the form of a table of speed corrections which are a function of the absolute value of the time lapse separating the moment of occurrence of the predetermined state from the moment when the actual speed of the engine is to meet the final low-idle speed, following said time law.

Further characteristics and advantages of the method according to the invention will become clear from reading the description which will follow and from examining the appended drawing in which:

DESCRIPTION OF THE PREFERRED EMBODIMENTS

As was indicated earlier, the present invention applies to an internal combustion engine equipped with means for slaving the speed, or speed of rotation, of the engine to a reference point speed, these means being contained within the computer 6 duly equipped with the necessary hardware and software means, as is well known. Conventionally, the automatic-control means serve particularly, in steady state low-idle speed, to ensure that the speed of the engine is stabilized to a chosen low-idle speed value. They may consist of "controllers" providing PI or PID regulation of this low-idle speed, or of controllers operating using "fuzzy logic" for example.

The method according to the invention involves prior detection of a running state of the engine which requires immediate implementation of a strategy for controlling this engine able to prepare it to run at a so-called "low-idle" speed as is the case, for example, when the driver slows down the vehicle with a view to stopping it, the engine continuing to turn over after coming to rest with a speed regulated by the automatic-control means mentioned earlier.

The existence of such a running state is recognized by reference to the following predetermined state:

1) the driver has lifted his foot off the throttle pedal. It is known that, conventionally, a "foot off" contact then closes in order to send a corresponding signal to the computer. This condition may possibly be combined with other optional conditions such as:
2) at the moment when the foot is lifted off, the speed of rotation of the engine is below a threshold Nth drawn, for example, from a table as a function of the temperature of the engine cooling water or calculated as a function of the final reference point speed,
3) the vehicle is stationary.

Figure 1:
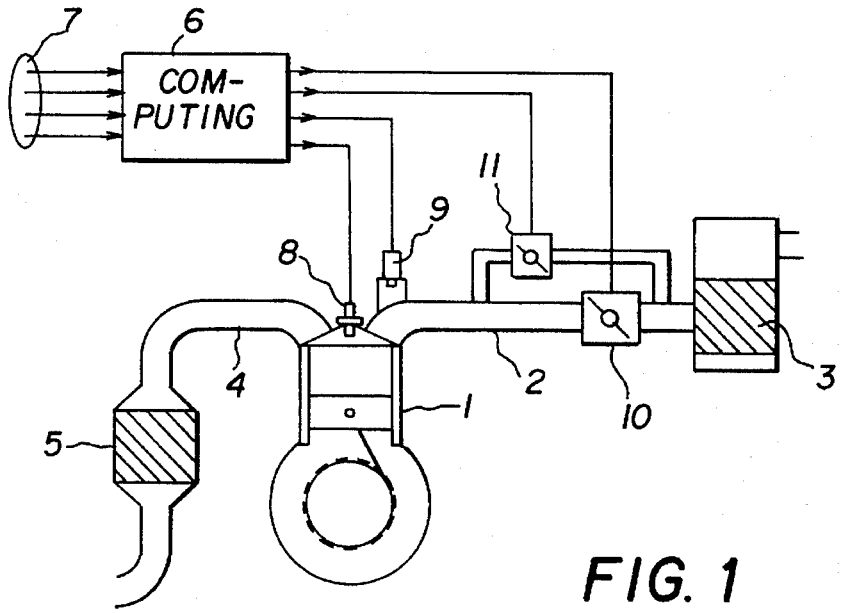
FIGS. 1, 2 and 3 are respectively a diagram of a device allowing implementation of the method according to the invention and of graphs commented upon in the preamble to the present description.
Figure 2:
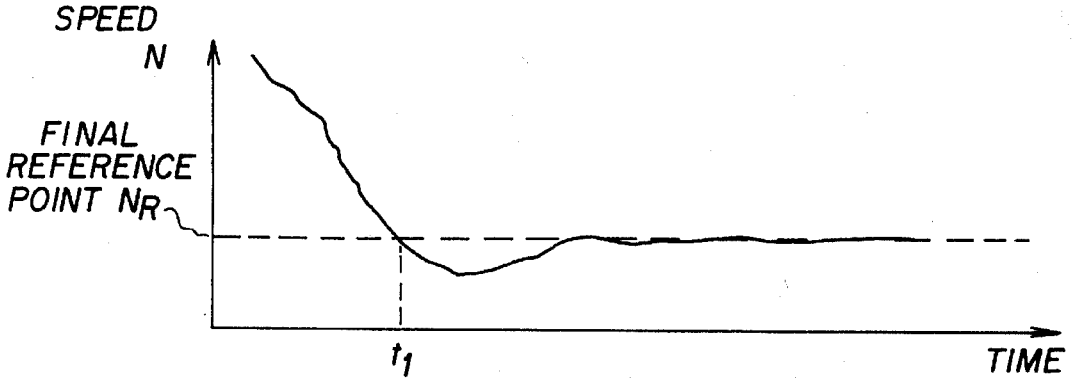
Figure 3:
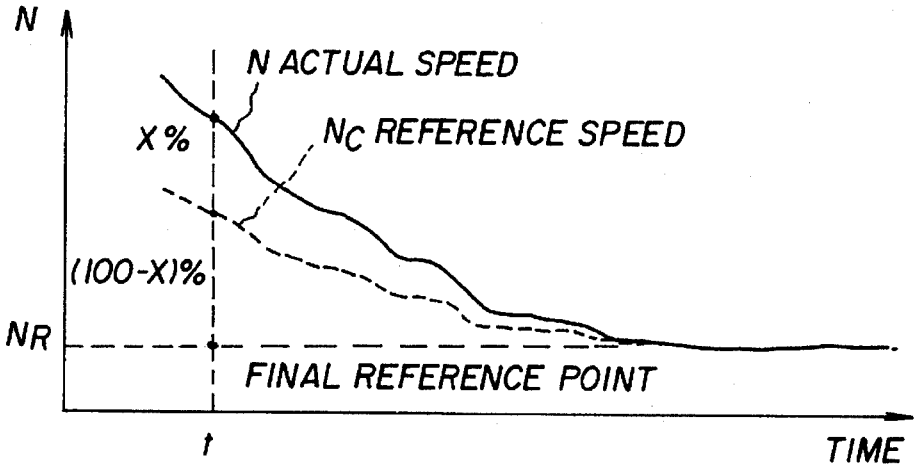
FIG. 3 PRIOR ART
Figures 4, 5:
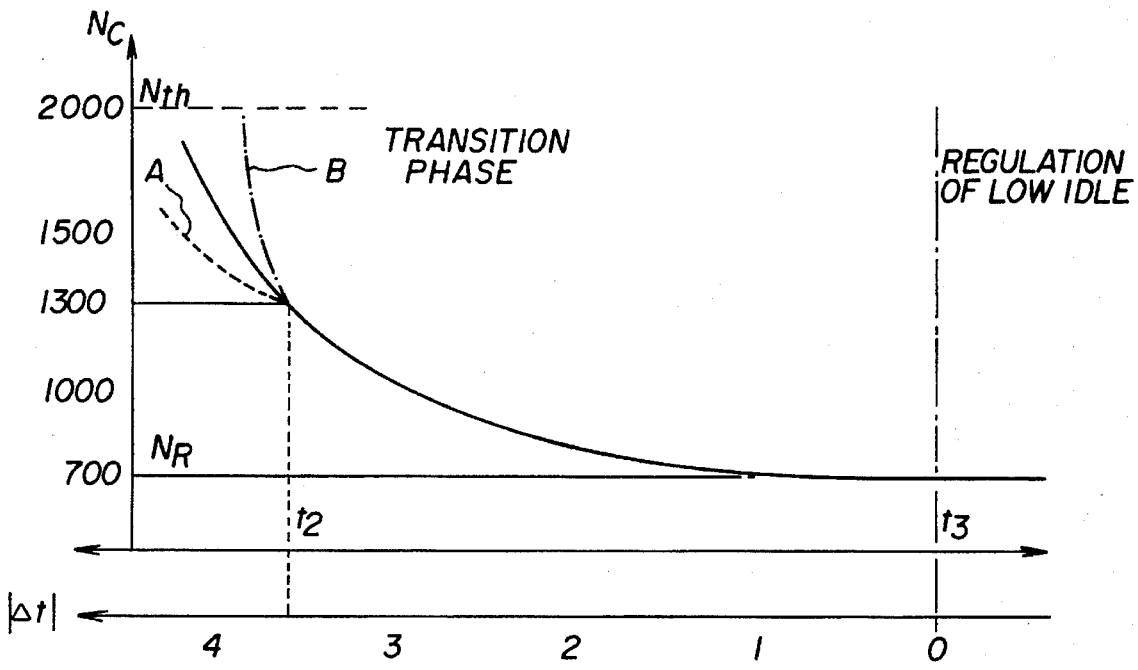
FIG. 4 is a graph which is useful in explaining the method according to the present invention.
FIG. 5 is a table stipulating the time law used in the present invention.

Detection of such a predetermined state is considered as calling for entry of the running of the engine into low-idle speed, which entry, according to an essential characteristic of the method according to the invention, will take place by forcing the actual speed N of the engine to decrease, closely following a reference speed N decreasing as a function of time according to a time law like the one illustrated by the graph in FIG. 4.

When the predetermined running state of the engine appears, for example when the "foot off" signal is detected, the computer 6 samples the actual speed of the engine. By way of example, as represented in FIG. 4, the "foot off" signal occurs at the moment t while the engine is turning over at 1300 rpm. In the knowledge that the law for forcing the speed of the engine must bring this speed to a low-idle speed N of 700 rpm for example, the computer looks, in a table (FIG. 5) stored in memory, for the absolute value of a time lapse Δt=t−t such that, by following this law, the speed changes from 1300 rpm (at t) to:

$$1300-600=700 \text{ rpm (at t)}$$

The table then indicates |Δt|=3.4 s, this value in fact being obtained by interpolation between two values, in memory, on either side of it, namely 3 s and 3.5 s.

It will be understood that the reference point speed is of the form:

$$N=N+\Delta N$$

with ΔN=f(|Δt|), a corrective term stored in memory in the table. The various values of ΔN featured in the table may easily be calculated so that the decrease in reference point speed follows any predetermined profile, for example a parabolic, hyperbolic or exponential one. The correction ΔN obviously decreases with time so that it cancels itself out at the moment t when the reference point speed N meets the final low-idle speed N. This is what is expressed in the table of FIG. 5. By taking the absolute value |Δt| of the time elapsed between the moments t and t into account, the graph of FIG. 4 is read somewhat "backward", as the |Δt| axis represented in this figure indicates.

The value of the reference point speed N (t) could also be expressed by making direct use of a function of time representing the values to be obtained. By way of example, the following function makes it possible to obtain values similar to those given in the table of FIG. 5:

$$N_C(t) = N_R + 20\left(\sqrt[3]{\frac{\Delta N_2}{20}} - t\right)^3 \quad \text{for } N(t) > N$$

and $$N(t) = N \text{ for } N(t) \leqq N$$

where:

ΔN represents the discrepancy between the engine speed at the moment t and the final reference point speed N, N (t), N and ΔN are expressed in revolutions/minute, t in seconds.

It will be understood that the decrease in reference point speed is initialized, at the moment t, so as to change in accordance with the time law N (t) fixed by the table, regardless of any previous changes (see graph curves A or B, FIG. 4) in the actual engine speed. From the moment t onward, the reference point speed enters a transition phase during which the computer uniformly decrements the value of ΔN in accordance with the table of FIG. 5, until the moment t for which |Δt|=0 and N=N=700 rpm, for example. The means mentioned earlier for automatically controlling speed then regulate the speed to this value, during the steady-state low-idle phase.

Advantageously, according to the invention, the automatic-control means, using PI or PID regulation for example, also cause the forced reference point speed N to be followed during the transition phase.

A nominal value of the control parameter or parameters (amount of gasoline, opening of the additional air valve, injection or ignition advance, etc.) which are corrected by the automatic-control means as a function of the behavior of the actual speed with respect to the reference point speed corresponds to each reference point speed value.

It is now clear that the present invention indeed affords the stated advantages. The drop in speed is perfectly controlled and always remains the same, each time the engine returns to low-idle speed. Furthermore, it will be observed that the control strategy according to the invention makes it possible to anticipate the reaction of the automatic-control means when a parasitic load disturbs the normal behavior of the engine under no load, and does so even before the final reference point speed is reached in low-idle regulation, this diminishing the risk of the engine stalling in return. It will further be observed that the fine-tuning of the entry into low-idle regulation is easier because the method according to the invention is more robust with regard to disturbance.

We claim:

1. An apparatus for controlling a speed of an internal combustion engine during an entry thereof into low-idle speed operation, comprising:

a device connected to an internal combustion engine for measuring the speed of the engine and for monitoring a state of the engine;

means connected to receive signals from said device concerning the speed and the state of the engine, said means being operatively connected with the engine for slaving the engine speed to a predetermined reference point value, said means being programmed to (a) determine a low-idle speed of the engine;

(b) monitor the engine for the possible appearance of a predetermined running state calling for an entry into low-idle speed operation and, when such a state is detected, (c) gradually decrease said reference point value according to a predetermined time law independently of a rate of decrease in the speed beginning when the predetermined running state occurs, to the predetermined low-idle speed.

2. The apparatus according to claim 1, wherein said means are further programmed to measure an actual engine speed at the moment when the predetermined running state occurs, and to initialize the decrease in speed with the actual engine speed and to continue with the predetermined time law.

3. A method of controlling the speed of an internal combustion engine during an entry thereof into low-idle speed operation, the method which comprises:

(a) initially storing in memory a predetermined time law of speed corrections, the predetermined time law being independent of a rate of decrease in the speed at a moment at which a predetermined running state calling for an entry into low-idle speed operation occurs;

(b) determining a final low-idle speed of the engine;

(c) monitoring the engine for the possible appearance of the predetermined running state and, when such a state is detected, (d) measuring an actual engine speed, (e) initializing a reference point speed of the engine with the actual speed measured in step (d), (f) defining a time lapse separating the moment when the predetermined state occurs from a moment when the engine is to reach final low-idle speed operation, from a difference between the actual speed measured and the final low-idle speed according to the predetermined time law, (g) defining at each of a plurality of moments, a speed correction according to the predetermined time law as a function of a remaining time of the time lapse, (h) decreasing the reference point speed according to each speed correction, and (i) adjusting the actual speed of the engine toward the reference point speed.

4. The method according to claim 3, wherein the internal combustion engine propels a motor vehicle and a driver defines an operation of the vehicle by depressing an accelerator pedal, and the method comprises defining the predetermined state calling for the entry into low-idle speed operation when the driver releases the accelerator pedal.

5. The method according to claim 4, which comprises further defining the predetermined state when the actual engine speed falls below a predetermined threshold value.

6. The method according to claim 5, which further comprises determining the threshold value in dependence on an engine coolant temperature.

7. The method according to claim 3, wherein the predetermined time law is a table of speed correction versus a period of time.

* * * * *